US008347677B2

(12) United States Patent
Flandrinck

(10) Patent No.: US 8,347,677 B2
(45) Date of Patent: Jan. 8, 2013

(54) RELEASABLE LOCK FOR A MOTOR VEHICLE LOCK MECHANISM

(75) Inventor: Christian Flandrinck, Creteil (FR)

(73) Assignee: Valeo Securite Habitacle, Créteil (FR)

( * ) Notice: Subject to any disclaimer, the term of this patent is extended or adjusted under 35 U.S.C. 154(b) by 0 days.

(21) Appl. No.: 12/064,212

(22) PCT Filed: Aug. 10, 2006

(86) PCT No.: PCT/EP2006/065226
§ 371 (c)(1),
(2), (4) Date: Feb. 19, 2008

(87) PCT Pub. No.: WO2007/020232
PCT Pub. Date: Feb. 22, 2007

(65) Prior Publication Data

US 2008/0216532 A1 Sep. 11, 2008

(30) Foreign Application Priority Data

Aug. 17, 2005 (FR) ..... 05 08573

(51) Int. Cl.
*E05B 14/04* (2006.01)

(52) U.S. Cl. ..... 70/379 R; 70/360; 70/380

(58) Field of Classification Search ..... 70/379 R, 70/380, 422, 492, 495, 496, 218, 360, 367, 70/419, 491
See application file for complete search history.

(56) References Cited

U.S. PATENT DOCUMENTS 904,580 A * 11/1908 Voight ..... 70/374
3,659,444 A * 5/1972 Wellekens ..... 70/379 R
5,233,851 A * 8/1993 Florian ..... 70/367
5,263,348 A * 11/1993 Wittwer ..... 70/379 R
5,265,453 A * 11/1993 Konii et al. ..... 70/379 R
5,295,377 A * 3/1994 Moricz et al. ..... 70/379 R
5,640,864 A * 6/1997 Miyamoto ..... 70/379 R
5,732,580 A * 3/1998 Garnault et al. ..... 70/379 R
5,884,512 A * 3/1999 Wayne ..... 70/370

(Continued)

FOREIGN PATENT DOCUMENTS

EP 0 943 758 9/1999

(Continued)

OTHER PUBLICATIONS

International Search Report (French and English) for PCT/EP2006/065226 mailed Dec. 14, 2006 (6 pages).

(Continued)

*Primary Examiner* — Christopher Boswell

(74) *Attorney, Agent, or Firm* — Osha Liang LLP

(57) ABSTRACT

A releasable latch, for a motor vehicle lock mechanism, includes a fixed stator having at least two semicylindrical portions, a rotor rotatably mounted in the fixed stator and includes a plurality of tumblers configured to be moved radially under an action of a key that is designed to be inserted axially into the rotor, and an intermediate tubular socket configured to rotate about an axis thereof in the fixed stator and to move axially relative to the fixed stator. The rotor is directly coupled with a control lever that acts as a cam when the key is suitable, and uncoupled from the control lever in a released position. The rotor is fixed axially in the intermediate socket, and the rotor and the intermediate socket are prevented from rotating relative to one another by the plurality of tumblers when the key is not suitable.

14 Claims, 3 Drawing Sheets

U.S. PATENT DOCUMENTS

| | | | | |
|---|---|---|---|---|
| 5,911,766 | A | 6/1999 | Lieb et al. | |
| 6,301,942 | B1 * | 10/2001 | Shvarts | 70/367 |
| 6,393,882 | B1 * | 5/2002 | Higgins | 70/370 |
| 6,439,016 | B1 * | 8/2002 | Wittwer et al. | 70/379 R |
| 6,523,382 | B1 | 2/2003 | Dimig et al. | |
| 6,711,924 | B2 * | 3/2004 | Ritz | 70/379 R |
| 7,137,280 | B2 * | 11/2006 | Capka et al. | 70/379 R |
| 7,472,570 | B2 * | 1/2009 | Yamaguchi et al. | 70/379 R |
| 2004/0250579 | A1 * | 12/2004 | Capka et al. | 70/492 |

FOREIGN PATENT DOCUMENTS

| | | |
|---|---|---|
| WO | 02/097222 | 12/2002 |
| WO | 2004/035971 | 4/2004 |

OTHER PUBLICATIONS

Written Opinion of ISA (French) for PCT/EP2006/065226 mailed Dec. 14, 2006 (4 pages).

* cited by examiner

RELEASABLE LOCK FOR A MOTOR VEHICLE LOCK MECHANISM

The invention relates to a releasable latch for a motor vehicle lock mechanism.

The addition of a release mechanism on a latch designed for a motor vehicle lock makes it possible to prevent this latch from being forced.

Such a releasable latch is described in patent document WO02/097222.

Such a releasable latch, particularly for a motor vehicle lock mechanism, comprises a fixed stator consisting of at least two semicylindrical portions, a rotor that is rotatably mounted in the stator and that comprises tumblers that can be moved radially under the action of a key designed to be inserted axially into the rotor, the rotor being coupled with a control lever, called a cam, when the key is suitable, and uncoupled from the latter in the released position.

The release is carried out by means of ribs arranged on the inside of the stator and the rotor is coupled to an output element equivalent to a control lever, by means of a dog.

According to this known latch, the rotor and the dog guided in rotation on the rotor are in a configuration that is substantially in an end-to-end disposition. These two parts are substantially placed with one as an extension of the other.

The dog comprises a main ring and guide lugs that extend axially from the ring and that are designed to be received in matching axial notches of the control lever.

This latch arrangement poses the following technical problems.

Through its configuration in end-to-end disposition, such a latch is relatively long.

Furthermore, the dog is a relatively fragile part because of the way it is made.

The parts forming this latch are relatively numerous and pose a problem of angular clearance between them.

Furthermore, the constitution of the releasing device inside the stator may cause the tumblers to lock relatively easily and wear of the stator by these tumblers in the released position.

The invention solves these problems by proposing a particularly compact releasable latch, that is to say of limited length, and of particularly robust constitution.

To do this, the invention proposes a releasable latch, particularly for a motor vehicle lock mechanism, comprising a fixed stator consisting of at least two semicylindrical portions, a rotor that is rotatably mounted in the stator and that comprises tumblers that can be moved radially under the action of a key designed to be inserted axially into the rotor, the rotor being coupled with a control lever called a cam when the key is suitable, and uncoupled from the latter in the released position, the latch characterized in that said coupling of the rotor and of the cam is direct and in that the latch comprises an intermediate tubular socket that is mounted so as to rotate about its axis in the stator and that can be moved axially relative to the stator, the rotor being fixed axially in the intermediate socket and the rotor and the intermediate socket being prevented from rotating relative to one another by the tumblers when the key is not suitable.

Such a latch has a particularly reduced space requirement. Its length may be reduced by approximately 8 mm relative to a known latch. As an example, it is possible to make a latch with a length of less than 45 cm and a diameter of less than 30 mm.

The efficiency of a latch according to the invention is further enhanced since the drive train in normal operation comprises only two parts in mutual engagement, the rotor and the cam.

According to a preferred embodiment, the rotor and the intermediate socket are connected in translation in a direction going from the cam to the key entrance, against the force of a compression spring.

Preferably, the latch also comprises an indexer that can be axially moved between a rest position and a released position, under the effect of a rotation of the socket relative to the stator following the rotation of the rotor with the aid of an unsuitable key, this indexer being connected in rotation to the cam.

Advantageously, the rotor and the indexer are connected in translation.

The stator may comprise a guidance and abutment contact block on its inner face.

Preferably, the intermediate socket comprises a notch with inclined sides designed to receive said contact block in the engaged position.

And advantageously, the indexer comprises inclined faces designed to come against said contact block in the released position.

According to the invention preferably said two stator portions immobilize via one of their ends a key head by means of a groove arranged at this end.

The key head may therefore be mounted independently of the parts forming the latch and may be chosen according to required forcing or corrosion stresses.

Advantageously, said two stator portions come to be immobilized by means of a flange in an annular groove arranged on the cam.

The latch according to the invention has an enhanced resistance to forcing whether it be to wrenching out or driving in.

This inviolability is also strengthened by a reduced angle at the cam on the rear portion. The latch according to the invention has a clearance angle at this level of less than 8° instead of 15° in the known latches.

The invention is described below in greater detail with the aid of figures that represent only a preferred embodiment of the invention.

FIG. 1 shows a rotary latch with a longitudinal axis A1 comprising release means according to the teachings of the invention. This latch is represented in FIG. 2 in the initial position before the insertion of a key.

Figure 1:
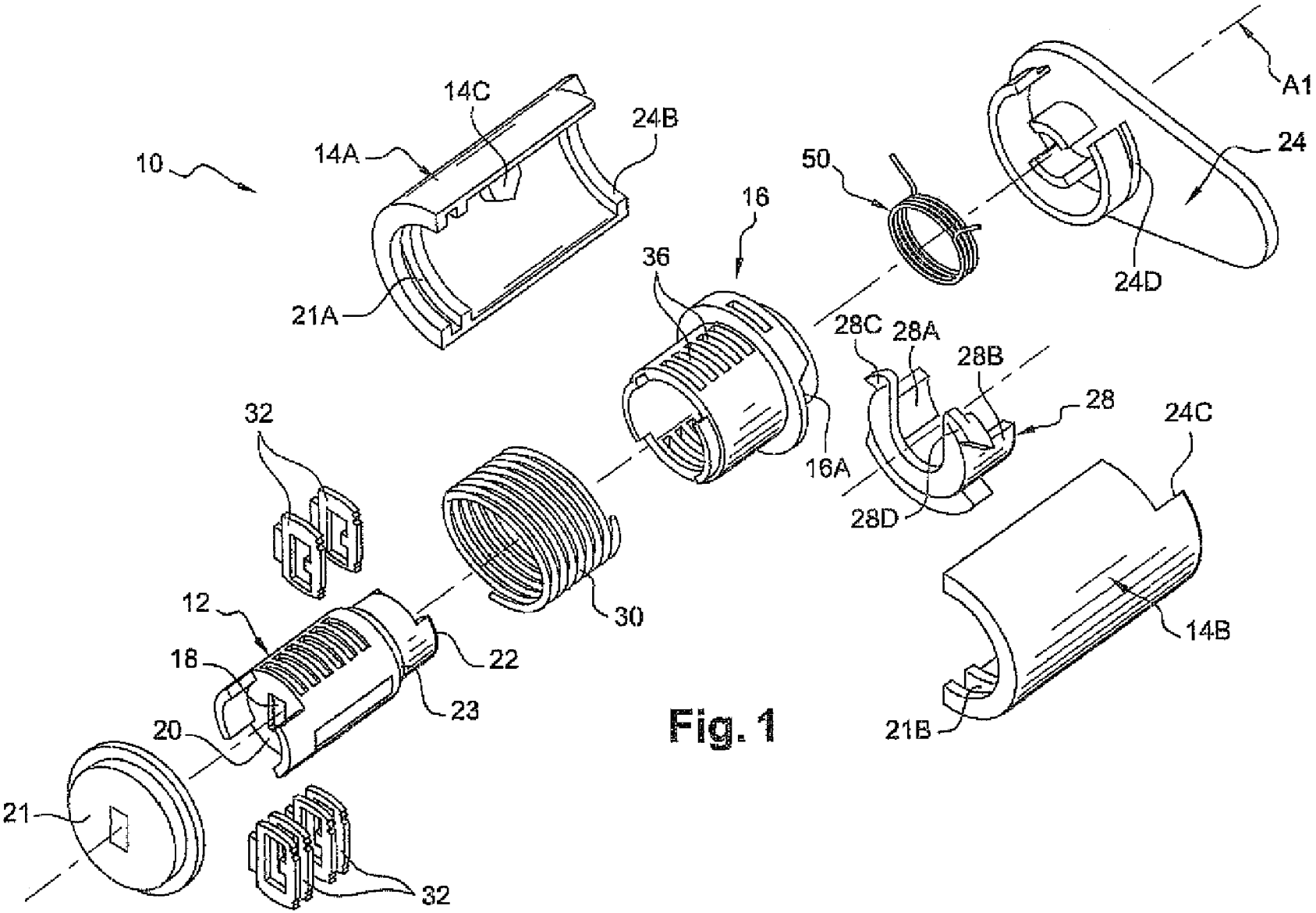
FIG. 1 is an exploded view in perspective of a releasable latch according to the invention.

The latch 10 essentially comprises a rotor 12 that is mounted so as to turn, about the axis A1, inside a fixed stator 14 consisting of two semicylindrical portions 14A and 14B, with interposition between the two of an intermediate tubular socket 16 that is mounted in rotation about its axis in the stator and that can be moved axially relative to the stator.

This intermediate socket 16 comprises, close to its transverse face turned toward the cam 24, over a portion of its periphery, a notch 16A whose sides are inclined. Furthermore, this socket is in abutment against the rotor thanks to an annular flange 16B (visible in FIG. 3), in a direction directed from the cam to the key entrance.

The rotor 12 is designed to be rotated with the aid of a key (not shown) inserted axially into the rotor 12 through a key entrance 18 arranged in a front transverse face 20 of the rotor 12, which face 20 is covered by a head cover 21 designed for example to be flush with the outside of a bodywork panel (not shown) of the vehicle.

The rear axial end 22 of the rotor 12 is designed to rotate a control lever or cylinder 24 of a lock mechanism (not shown) to allow the immobilization and release of an opening element of the vehicle.

The rotor 12 is capable of rotating the control lever 24, only in the presence of a suitable key, in an engaged position in which the rotor 12 and the control lever 24 are connected in rotation by means of an interlocking arrangement. In a released position, the rotor 12 is no longer able to rotate the lever 24.

A helical compression spring 30 is interposed between the stator 14 and the intermediate socket 16 to move the latter axially rearward toward its engaged position.

The stator 14 has a generally cylindrical tubular shape, once the two portions 14A, 14B are assembled, and it may comprise means (not shown) that make it possible to mount and attach the latch 10 to the vehicle. The stator comprises, on its inner face, an abutment and guidance contact block 14C whose sides have a V shape that is tangential relative to this inner face on each of its ends. In the engaged position, the notch 16A of the intermediate socket is interlocked in this abutment and guidance contact block 14C under the force of the compression spring 30.

In a known manner, the rotor 12 is designed to receive tumblers 32 arranged in transverse planes that succeed one another at regular intervals in the direction of the axis A1 of the latch 10 and that are received in matching housings of the rotor 12.

The tumblers 32 can be moved radially in the rotor 12 and they are moved elastically to a protruding position in which they partially protrude from the housings of the rotor 12.

On the other hand, when a suitable key is inserted into the rotor 12, the tumblers 32 are fully retracted radially inward in the rotor 12.

Therefore, when the suitable key is inserted into the rotor 12, the latter may pivot freely relative to the cylindrical intermediate socket 16 and relative to the stator 14.

Figure 3:
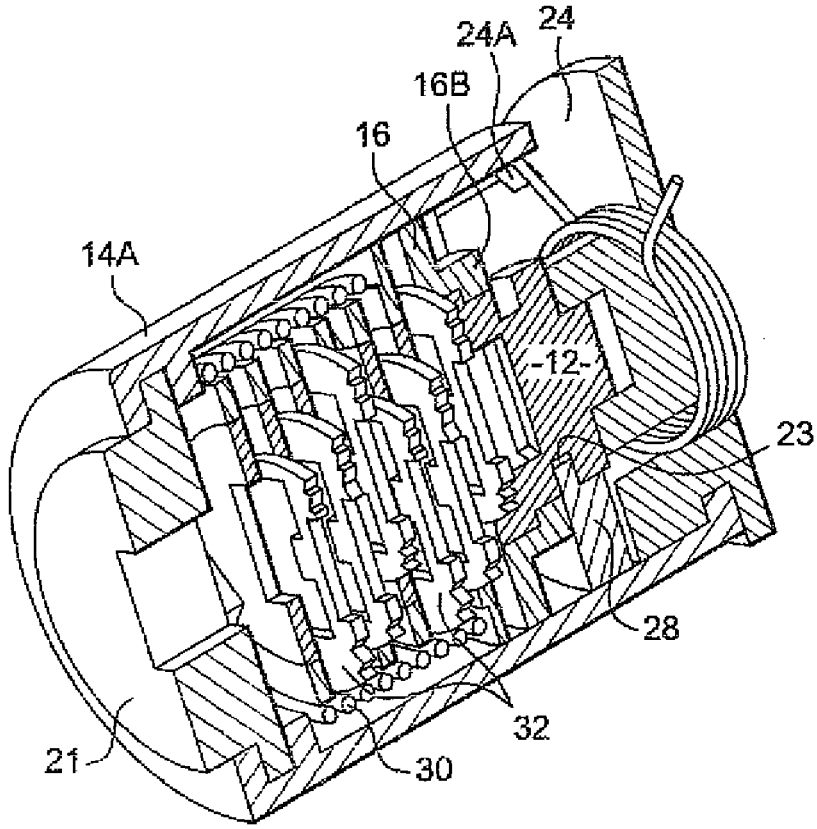
FIG. 3 is a view in cross section in the prerelease position.

On the other hand, if an unsuitable key, or any other tool, is inserted into the rotor 12, as illustrated in FIG. 3, the tumblers 34 are not fully retracted and are received inside matching windows 36 arranged in the intermediate socket 16. Therefore, the tumblers 34 prevent the rotor 12 from rotating relative to the intermediate socket 16 which, for its part, remains free to rotate relative to the stator 14.

An indexer 28 consists of an open ring that is clipped into a groove 23 arranged close to the end 22 of the rotor turned toward the cam 24. The indexer 28 is therefore connected in translation with the rotor. On this ring are arranged, in the direction of the cam, two tongues 28A, 28B for fitment into the cam 24. On its face turned toward the rotor, the indexer 28 comprises two inclined faces 28C and 28D. As will be seen below, these two inclined faces butt against the abutment and guidance contact block 14C of the stator in the released position.

The latch 10 also comprises a return spring 50 operating in torsion and used to return the cam 24 to the initial position.

The operation of the latch according to the invention will now be described with reference to the other figures.

Figure 4:
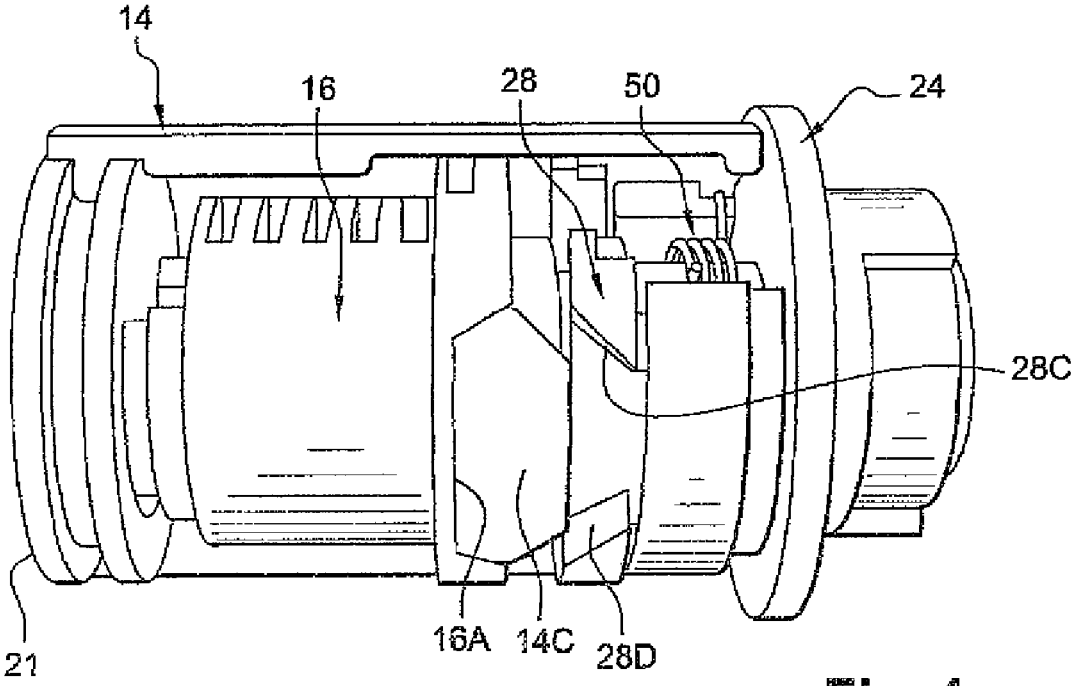
FIG. 4 is a view in perspective of a latch according to the invention, in the engaged position, the stator being only partially represented and the compression spring not being represented.

In FIG. 4, a suitable key has been inserted into the rotor 12 through the key entrance 18 and the latch is therefore in the engaged position. The tumblers 32 are therefore retracted inside the rotor 12 which may turn in the intermediate socket 16.

In this position, the rotor 12 may be turned with the key and carries with it the cam 24 in rotation, releasing the lock.

The intermediate socket 16 remains immobile in rotation, connected to the stator 14 by the abutment and guidance contact block 14C and the indexer 28 turns freely with the cam 24 by means of its two tongues 28A and 28B.

The rotation of the cam 24 is obtained by the rotation of the following parts: key/rotor/cam.

At the end of travel, when the key is released, the return spring 50, of which one end is fixed and another end is in abutment against a flange 24A of the cam 24, causes the cam to return to the initial position and the dog and the rotor.

Figure 5:
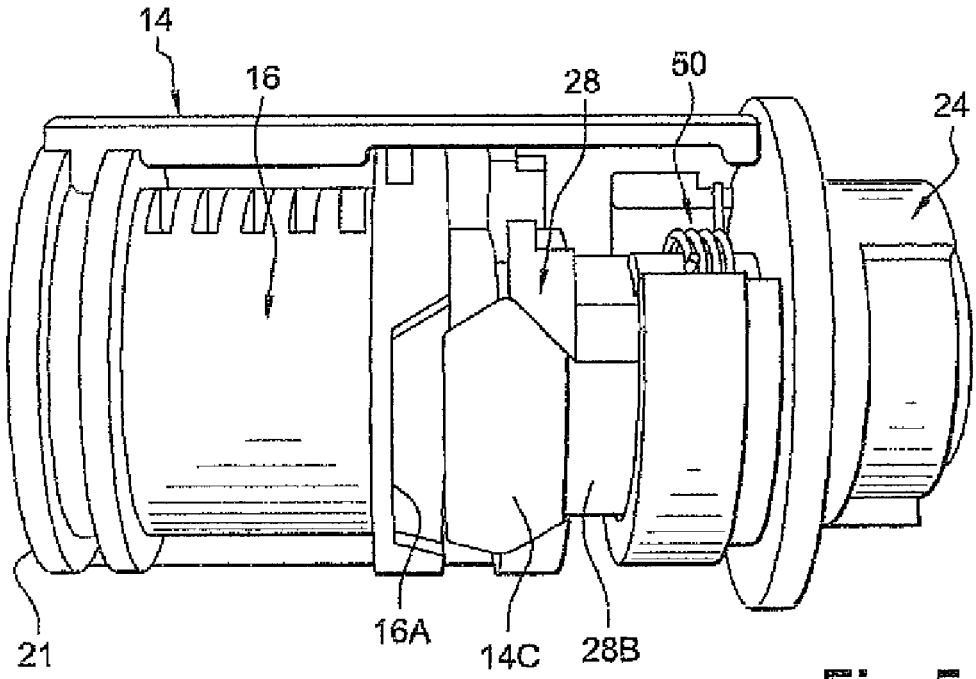
FIG. 5 is a view in perspective of a latch according to the invention, in the released position, the stator being only partially represented and the compression spring not being represented.

In FIGS. 3 and 5, an unsuitable key has been inserted into the rotor 12 through the key entrance 18 and the latch is therefore in the released position. The tumblers 32 are therefore not retracted inside the rotor 12 which is consequently connected in rotation to the intermediate socket 16, by fitment of the tumblers in the latter.

The rotation of the unsuitable key therefore rotates the rotor 12 and the intermediate socket 16 which are connected. This intermediate socket 16, through the interaction of one V side of the abutment and guidance contact block 14C, turned toward the rotor, and an inclined face of the notch 16A of the socket, is translated in the direction of the key entrance against the force of the compression spring 30. By its annular flange 16B, the intermediate socket 16 takes with it the rotor 12 in this translation in the direction of the key entrance. The rotor then disconnects from its interlocking with the cam 24. Furthermore, the rotor 12 and the indexer 28 being connected in translation, the indexer is also moved in the same direction and its inclined faces 28C and 28D butt against the V sides of the abutment and guidance contact block 14C, turned toward the cam. In this position, it is immobilized and blocks the cam by means of its two tongues 28A and 28B.

The intentional rotation of the key therefore causes the movement of the following parts: translation of the intermediate socket/translation of the rotor/translation of the indexer/prevention of the cam from rotating.

Figure 2:
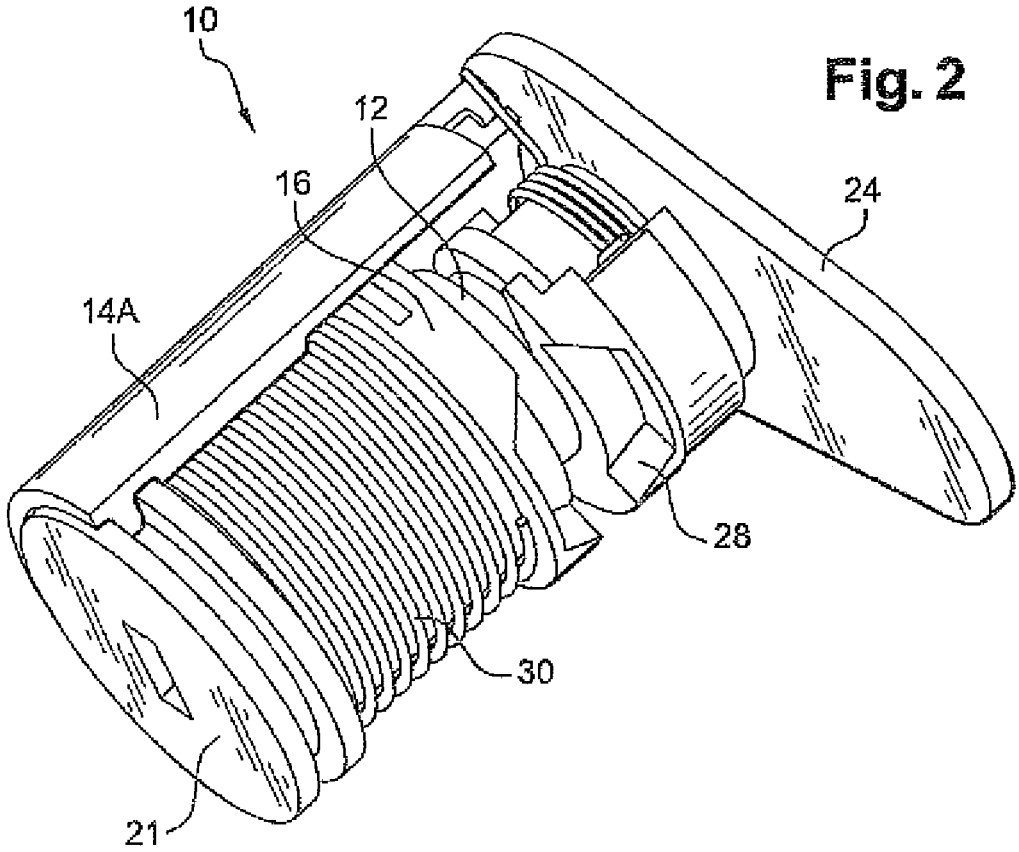
FIG. 2 is a view in perspective of the releasable latch according to the invention, in the initial position.

During the subsequent insertion of a suitable key, the rotor 12 is turned, thanks to the rotation of the key, to the initial position represented in FIG. 2, then the latch is engaged if the key is suitable or is released if the key is not suitable.

The latch according to the invention is provided with an armored rotor head 21, for example made of sintered steel. The two-portion stator 14 also enhances impact-resistance.

This latch has inviolability qualities that are increased relative to the prior art.

The two stator portions 14A, 14B enclose the parts forming the latch and, via one of their ends, immobilize the key head 21 by means of a groove 21A, 21B arranged at this end and in which the key head is interlocked. At their other end, they are immobilized by means of a flange 24B, 24C in an annular groove 24D arranged on the cam 24.

The invention claimed is:

1. A releasable latch, for a motor vehicle lock mechanism, comprising:

a fixed stator having an assembly of at least two distinct semicylindrical portions, wherein the fixed stator comprises a guidance and abutment contact block on an inner face thereof;

a rotor rotatably mounted in the fixed stator, the rotor being sandwiched by the two semicylindrical portions and comprising a plurality of tumblers configured to be moved radially under an action of a key that is designed to be inserted axially into the rotor;

an intermediate tubular socket configured to rotate about an axis thereof in the fixed stator and to move axially relative to the fixed stator; and an indexer configured to be axially moved between a rest position and a released position, the indexer comprising two tongues configured to fit into a cam and to be connected in rotation to the cam;

wherein, in the released position, the indexer is configured to butt against the guidance and abutment contact block thereby immobilizing the indexer, wherein the rotor is directly coupled with a control lever that acts as the cam when the key is suitable, wherein the rotor is uncoupled from the control lever in a released position wherein the rotor is fixed axially in the intermediate socket, wherein the rotor and the intermediate socket are prevented from rotating relative to one another by the plurality of tumblers when the key is unsuitable, and wherein, under an effect of a rotation of the intermediate socket relative to the fixed stator following the rotation of the rotor with the unsuitable key, the indexer is immobilized and blocks the rotation of the cam by means of the two tongues.

2. The latch as claimed in claim 1, wherein the rotor and the intermediate socket are connected in translation in a direction going from the cam to a key entrance, against a force of a compression spring.

3. The latch as claimed in claim 2, wherein said two stator portions immobilize a key head by means of a groove arranged at an end thereof.

4. The latch as claimed in claim 2, wherein said two stator portions come to be immobilized by means of a flange in an annular groove arranged on the cam.

5. The latch as claimed in claim 1, wherein the rotor and the indexer are connected in translation.

6. The latch as claimed in claim 5, wherein said two stator portions immobilize via one of a key head by means of a groove arranged at an end thereof.

7. The latch as claimed in claim 5, wherein said two stator portions come to be immobilized by means of a flange in an annular groove arranged on the cam.

8. The latch as claimed in claim 1, wherein the intermediate socket comprises a notch with inclined sides designed to receive said contact block in an engaged position.

9. The latch as claimed in claim 1, wherein the indexer comprises inclined faces designed to come against said contact block in the released position.

10. The latch as claimed in claim 1, wherein said two stator portions immobilize a key head by means of a groove arranged at an end thereof.

11. The latch as claimed in claim 1, wherein two stator portions come to be immobilized by means of a flange in an annular groove arranged on the cam.

12. The latch as claimed in claim 1, wherein the indexer comprises inclined faces designed to come against said contact block in the released position.

13. The latch as claimed in claim 1, wherein said two stator portions immobilize a key head by means of a groove arranged at an end thereof.

14. The latch as claimed in claim 1, wherein said two stator portions come to be immobilized by means of a flange in an annular groove arranged on the cam.

* * * * *